US009618905B2

(12) United States Patent
Lin

(10) Patent No.: US 9,618,905 B2
(45) Date of Patent: Apr. 11, 2017

(54) HOROLOGE

(71) Applicant: Xiangping Lin, Fuzhou (CN)

(72) Inventor: Xiangping Lin, Fuzhou (CN)

(73) Assignee: FUZHOU XIAOSHENLONG WATCH TECHNOLOGY RESEARCH CO., LTD., Fuzhou (CN)

( * ) Notice: Subject to any disclaimer, the term of this patent is extended or adjusted under 35 U.S.C. 154(b) by 0 days.

(21) Appl. No.: 14/240,888

(22) PCT Filed: Dec. 11, 2012

(86) PCT No.: PCT/CN2012/086330
§ 371 (c)(1),
(2) Date: Feb. 25, 2014

(87) PCT Pub. No.: WO2014/067209
PCT Pub. Date: May 8, 2014

(65) Prior Publication Data

US 2015/0234359 A1 Aug. 20, 2015

(30) Foreign Application Priority Data

Oct. 30, 2012 (CN) ..... 2012 1 0431014

(51) Int. Cl.
*G04C 3/04* (2006.01)
*G04C 11/08* (2006.01)
*G04B 17/28* (2006.01)

(52) U.S. Cl.
CPC ..... *G04C 3/04* (2013.01); *G04B 17/285* (2013.01); *G04C 11/088* (2013.01)

(58) Field of Classification Search
CPC ... G04C 1/00; G04C 3/00; G04C 3/14; G04C 3/146; G04C 3/04; G04C 11/088; G04B 13/00; G04B 17/28; G04B 17/285
USPC ..... 368/127, 155–157
See application file for complete search history.

(56) References Cited

U.S. PATENT DOCUMENTS

| | | | | |
|---|---|---|---|---|
| 3,921,386 | A * | 11/1975 | Keller | 368/161 |
| 3,937,001 | A * | 2/1976 | Berney | 368/159 |
| 5,025,428 | A * | 6/1991 | Jarochowski | 368/126 |
| 5,517,469 | A * | 5/1996 | Wiget | 368/140 |
| 6,314,059 | B1 * | 11/2001 | Shimizu et al. | 368/157 |
| 6,554,468 | B1 * | 4/2003 | Manaka et al. | 368/127 |

* cited by examiner

*Primary Examiner* — Vit W Miska
(74) *Attorney, Agent, or Firm* — Gokalp Bayramoglu

(57) ABSTRACT

Disclosed in the present application is a horologe, a timekeeping system thereof including: a winding mechanism powering the second hand, minute hand and hour hand; a mechanical transmission wheel train engaged with the winding mechanism and driving the second hand, minute hand and hour hand to operate, wherein the mechanical transmission wheel train comprises a tourbillion mechanism driving a second wheel connected with the second hand to rotate; an accuracy control device, wherein the timekeeping motor of the accuracy control device drives the rotation of the rotor and the timekeeping accuracy of the timekeeping motor is controlled by a quartz crystal oscillator; and an electronic transmission wheel train connected to the rotor. The horologe disclosed in the present application can solve the problem that the timekeeping accuracy of the mechanical horologe is poor.

10 Claims, 7 Drawing Sheets

HOROLOGE

FIELD OF THE INVENTION

The present application relates to the technical field of timepieces, and more particularly to a horologe.

BACKGROUND OF THE INVENTION

At present, there generally are two kinds of horologes on the market, i.e., mechanical horologes and electronic quartz horologes. The mechanical horologe has an exquisite technological structure, in which a balance wheel keeps swinging to produce a ticking sound and a second hand jumps continuously, so as to render a person to experience the lapse of time, and meanwhile the motion of the internal parts of the horologe movements gives an elegant aesthetic feeling to a person. However, the biggest flaw of the mechanical horologe is that the timekeeping accuracy is low. Currently, the timekeeping accuracy of the horologe with a tourbillion mechanism is difficultly controlled to be within 5 seconds of daily error.

SUMMARY OF THE INVENTION

There is provided a horologe in the present application, which can solve the problem that the timekeeping accuracy of the mechanical horologe is low.

To solve the problem described above, the following solutions are proposed.

With the horologe according to the present application, a timekeeping system thereof comprises:

a winding mechanism providing power for a second hand, a minute hand and an hour hand;

a mechanical transmission wheel train engaged with the winding mechanism and driving the second hand, the minute hand and the hour hand to operate; the mechanical transmission wheel train comprises a tourbillion mechanism driving a second wheel to rotate, the second wheel is connected with the second hand, wherein the mechanical transmission wheel train further comprises a second transmission wheel located at the output end of the mechanical transmission wheel train, the second transmission wheel meshes with the second wheel, and the rotational speed of the second wheel driven by the mechanical transmission wheel train is faster than that of the second wheel in standard time;

an accuracy control device comprising a timekeeping motor for driving a rotor to rotate, wherein timekeeping accuracy of the timekeeping motor is controlled by a quartz crystal oscillator;

an electronic transmission wheel train connected with the rotor and comprising a first transmission wheel, each of the first transmission wheel and the second transmission wheel being provided with three wheel pieces, wherein a first wheel piece of the first transmission wheel is a gear wheel meshed with the rotor, a first wheel piece of the second transmission wheel is a round wheel piece with a groove, a second wheel piece of the first transmission wheel is provided with a plurality of first wheel blades, an outer edge of the first wheel blade is in an inward-concave arc shape meshed with the round wheel piece, a third wheel piece of the first transmission wheel is provided with a plurality of second wheel blades, a second wheel piece of the second transmission wheel is a long-arm shaped wheel piece which can extend in between two adjacent second wheel blades, and a third wheel piece of the second transmission wheel is a gear wheel meshed with the second wheel.

Preferably, the transmission ratio of the second transmission wheel to the first transmission wheel is 1:4.

Preferably, each of two ends of a central shaft of the tourbillion mechanism is provided with a fixing splint.

Preferably, the tourbillion mechanism includes: a large flywheel provided with a gear wheel piece and having no hairspring and no escape fork, an intermediate wheel meshed with the gear wheel piece of the large flywheel, and a flywheel meshed with the intermediate wheel; and each of the large flywheel and the flywheel makes a revolution around the central shaft of the tourbillion mechanism and a rotation around its axis, and a resistance sheet for limiting the speed of the large flywheel is provided on the large flywheel.

Preferably, the accuracy control device is powered by a battery or an electricity generating device.

Preferably, the winding mechanism includes:

a stem;

a vertical wheel provided on the stem;

a clutch wheel meshed with the vertical wheel via one-way meshing teeth;

a crown wheel meshed with the vertical wheel;

a ratchet wheel meshed with the crown wheel, a tooth of the ratchet wheel being clamped by a clamp ring piece, and an one-way deformable sliding tooth being provided on the clamp ring piece; and a spring barrel provided with a spring, a periphery of the spring barrel being provided with a spring barrel tooth, and the spring barrel tooth being connected with one end of the spring.

Preferably, the electricity generating device includes an electricity generating motor, a voltage transformation and stabilization device connected to the generating motor, an electricity storage device connected to the voltage transformation and stabilization device, an electricity generating intermediate wheel driven by the ratchet wheel, and an electricity generating wheel driven by the electricity generating intermediate wheel, and the electricity generating motor is driven by the electricity generating wheel.

Preferably, the electricity generating device includes a micro-generator, a voltage transformation and stabilization device connected to the micro-generator, and an electricity storage device connected to the voltage transformation and stabilization device, and the micro-generator is coaxially connected to the second transmission wheel.

Preferably, the IC has a automatically identified stopping/starting timekeeping module, and when the operation of the mechanical transmission wheel train stops and after the module outputs a preset times of pulses, if the rotor does not rotate, the module enters a sleep state; when winding up, the ratchet wheel rotates and drives the electricity generating motor to run, and when the electricity is generated, the module is triggered to start working, and the timekeeping rotor is controlled again; or the module further includes a passing-through triggering switch, and when the ratchet wheel rotates, the triggering switch is moved by a gear wheel thereof, and when the triggering switch is continuously triggered for several times within several seconds, the module is reactivate.

Preferably, the IC of the accuracy control device outputs a signal to the timekeeping motor every 20 seconds, and the timekeeping motor drives the rotor to rotate once.

In the present application, an intermittent motion transmission is provided between the first transmission wheel controlled by the electronic transmission gear train and the second transmission wheel controlled by the mechanical transmission gear train. Specifically, the transmission ratio of the first transmission wheel to the second transmission wheel may be set according to an actual need; the first transmission wheel is of a structure having three wheel pieces, wherein the first wheel piece is a gear wheel meshed with the rotor, the second wheel piece is provided with a plurality of first wheel blades for achieving the intermittent motion, and the third wheel piece is also provided with a second wheel blade for achieving the intermittent motion; the second transmission wheel also is of a structure having three wheel pieces, wherein the first wheel piece thereof is engaged with the second wheel piece of the first transmission wheel, the second wheel piece of the second transmission wheel is a long-arm shaped wheel piece which is engaged with the second wheel blade provided on the third wheel piece of the first transmission wheel, so as to achieve a complete intermittent motion, and the third wheel piece of the second transmission wheel is a gear wheel meshed with the second wheel. Since the second wheel piece of the second transmission wheel is a long-arm shaped wheel piece, the arm of force is increased in order to reduce a thrust on the first transmission wheel transmitted from the mechanical portion, thereby guaranteeing that the locating torsion of the rotor can control the first transmission wheel. Since the first transmission wheel is controlled by the rotor, the locating torque exerted on the rotor by the timekeeping motor prevents the rotation of the first transmission wheel. Since the arm of force of the torsion transmitted from the second transmission wheel through the long-arm shaped wheel piece is long, the thrust force exerted on the first transmission wheel by the torsion is reduced. Meanwhile, a portion of the first transmission wheel pushed by the long-arm shaped wheel piece is a portion with a shorter radius of the third wheel piece of the first transmission wheel, and thus the second transmission wheel cannot drive the first transmission wheel. In this way, the first transmission wheel limits the rotation of the second transmission wheel. The length of the arm of force of the long-arm shaped wheel piece may be changed flexibly, as long as the first transmission wheel can limit the rotation of the second transmission wheel. Only when the timekeeping rotor drives the rotor to rotate, specifically, by 180°, the first transmission wheel just rotates one tooth with a certain transmission ratio. Thus, the second transmission wheel may go on rotating, that is, the mechanical hands may work continuously. Then, the second transmission wheel is limited by the first transmission wheel again, and when the timekeeping rotor again drives the rotor to rotate, the mechanical hands again may work continuously. That is, the rotational speed of the second transmission wheel may be controlled by the timekeeping rotor, thereby controlling the rotational speed of the second wheel, i.e., controlling the timekeeping accuracy of the second hand.

As may be seen from the technical solutions described above, in the horologe disclosed in the present application, an intermittent motion transmission is provided between the mechanical transmission wheel train and the electronic transmission wheel train. The electronic transmission wheel train will control the operation of the mechanical transmission wheel train, until the mechanical transmission wheel train is transmitted to the second transmission wheel by the transmission of the gear wheel, such that the operation of the second transmission wheel is limited by the first transmission wheel; and since the timekeeping motor controls the operation of the first transmission wheel by driving the rotation of the rotor, the timekeeping accuracy of the timekeeping motor is controlled by the quartz, that is, the timekeeping accuracy of the electronic transmission wheel train is also controlled by the quartz. In the case of the vibration frequency 32768 Hz of the quartz, the timekeeping accuracy being about±1 second of daily error can be ensured, so that the timekeeping accuracy of the hands of the mechanical transmission wheel train is controlled to be about ±1 second of daily error.

BRIEF DESCRIPTION OF THE DRAWINGS

Hereinafter, in order to illustrate embodiments of the application or technical solutions in the prior art more clearly, drawings required in description of the embodiments or the prior art will be introduced briefly. Obviously, the drawings introduced below relate to only some embodiments, and based on these drawings, other drawings may be obtained by the person skilled in the art without any creative efforts.

FIG. 6(*b*) is a structural schematic view of another tourbillion disclosed in an embodiment of the present application;

FIG. 7(*b*) is a schematic view of another tourbillion mechanism disclosed in an embodiment of the present application.

DETAILED DESCRIPTION OF THE INVENTION

Figure 1:
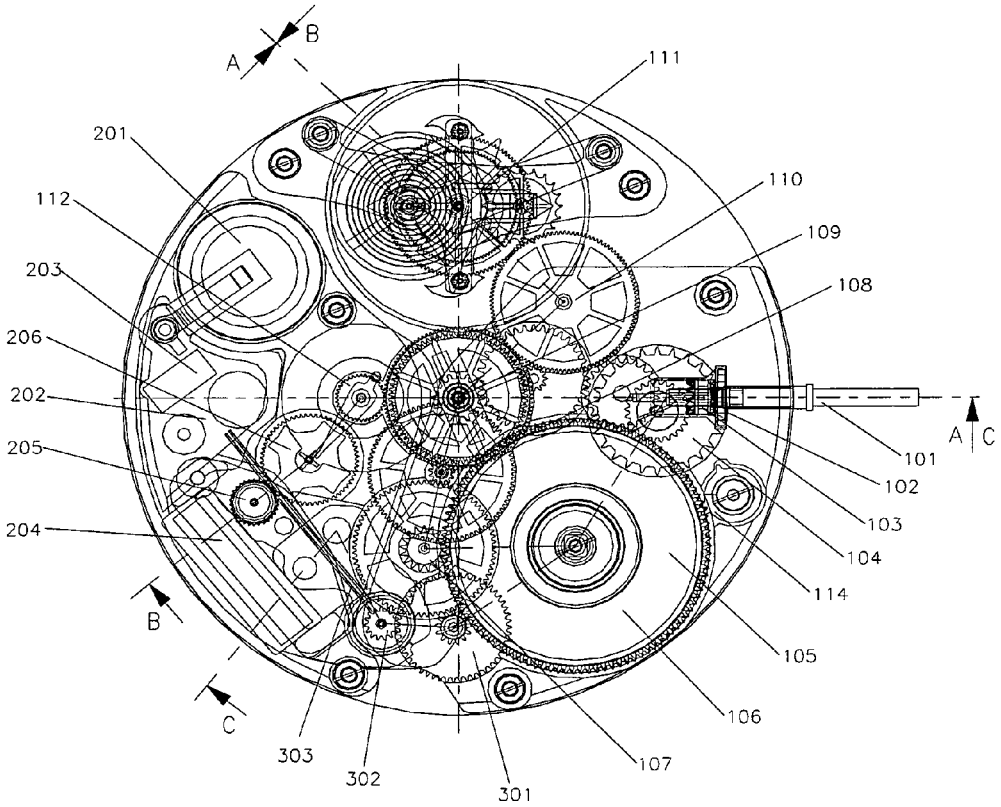
FIG. 1 is a structural plan view of a horologe disclosed in an embodiment of the present application.

The technical solutions in embodiments of the present application will be described clearly and completely in combination with the accompanying drawings in embodiments of the present application below. Apparently, those embodiments described are only a part of the embodiments of the present application, not all of the embodiments. Based on embodiments in the present application, all of other embodiments that can be obtained to those skilled in the art without a creative effort should belong to the scope of protection of the present application.

There is disclosed a horologe in an embodiment of the present application so as to solve the problem that the timekeeping accuracy of a mechanical horologe is poor.

With the horologe according to the present application, a timekeeping system thereof comprises:

a winding mechanism providing power for a second hand, a minute hand and an hour hand;

a mechanical transmission wheel train engaged with the winding mechanism and driving the second hand, the minute hand and the hour hand to operate; the mechanical transmission wheel train comprises a tourbillion mechanism driving a second wheel to rotate, the second wheel is connected with the second hand.

wherein the mechanical transmission wheel train further comprises: a second transmission wheel meshed with the second wheel; a transmission wheel train or a tourbillion component of a mechanical horologe movement meshed with the second wheel;

an accuracy control device including a timekeeping motor for driving a rotor to rotate, wherein timekeeping accuracy of the timekeeping motor is controlled by a quartz crystal oscillator;

an electronic transmission wheel train connected with the rotor, wherein the electronic transmission wheel train includes a rotor and a first transmission wheel meshed with the rotor; and wherein an intermittent motion transmission is provided between the second transmission wheel and the first transmission wheel.

Each of the first transmission wheel and the second transmission wheel is provided with three wheel pieces. The first wheel piece of the first transmission wheel is a gear wheel meshed with the rotor; the first wheel piece of the second transmission wheel is a round wheel piece with a groove; the second wheel piece of the first transmission wheel is provided with a plurality of first wheel blades, an outer edge of the first wheel blade being in an inward-concave arc shape engaged with the round wheel piece; the third wheel piece of the first transmission wheel is provided with a plurality of second wheel blades; the second wheel piece of the second transmission wheel is a long-arm shaped wheel piece which can extend in between two adjacent second wheel blades; and the third wheel piece of the second transmission wheel is a gear wheel meshed with the second wheel.

The intermittent motion transmission is provided between the second transmission wheel and the first transmission wheel. The transmission ratio of the second transmission wheel to the first transmission wheel in intermittent motion is 1:4, which also may be varied according to an actual need; the first transmission wheel is of a structure having three wheel pieces, wherein the first wheel piece is a gear wheel meshed with the rotor, the second wheel piece is provided with a plurality of first wheel blades for achieving the intermittent motion, and the third wheel piece is also provided with a second wheel blade for achieving the intermittent motion; the second transmission wheel also is of a structure having three wheel pieces, wherein the first wheel piece thereof is engaged with the second wheel piece of the first transmission wheel, the second wheel piece of the second transmission wheel is a long-arm shaped wheel piece which is engaged with the second wheel blade provided on the third wheel piece of the first transmission wheel, so as to achieve a complete intermittent motion, and the third wheel piece of the second transmission wheel is a gear wheel meshed with the second wheel. Since the second wheel piece of the second transmission wheel is a long-arm shaped wheel piece, the arm of force is increased in order to reduce a thrust on the first transmission wheel transmitted from the mechanical portion, thereby guaranteeing that the locating torsion of the rotor can control the first transmission wheel.

In the horologe disclosed in the present embodiment, an intermittent motion transmission is provided between the second transmission wheel and the first transmission wheel, and the electronic transmission wheel train will control the operation of the mechanical transmission wheel train. The mechanical transmission wheel train is connected to the tourbillion mechanism for driving the operation of the mechanical transmission wheel train of the second hand, minute hand and hour hand. That is, the operation of the mechanical transmission wheel train is controlled by the electronic transmission wheel train. Also, since the timekeeping motor controls the operation of the electronic transmission wheel train by driving the rotation of the rotor, the timekeeping accuracy of the timekeeping motor is controlled by the quartz, that is, the timekeeping accuracy of the electronic transmission wheel train is also controlled by the quartz. In the case of the vibration frequency 32768 Hz of the quartz, the timekeeping accuracy being about±1 second of daily error can be ensured, so that the timekeeping accuracy of the hands of the mechanical transmission wheel train is controlled to be about±1 second of daily error.

Moreover, since all of the second hand, minute hand and hour hand are powered by the winding mechanism, and there is no need for the accuracy control device to provide operational motive power. As such, the rotor also need not provide a larger torsion, so that it may be more power-efficient than a common quartz horologe.

Figure 2:
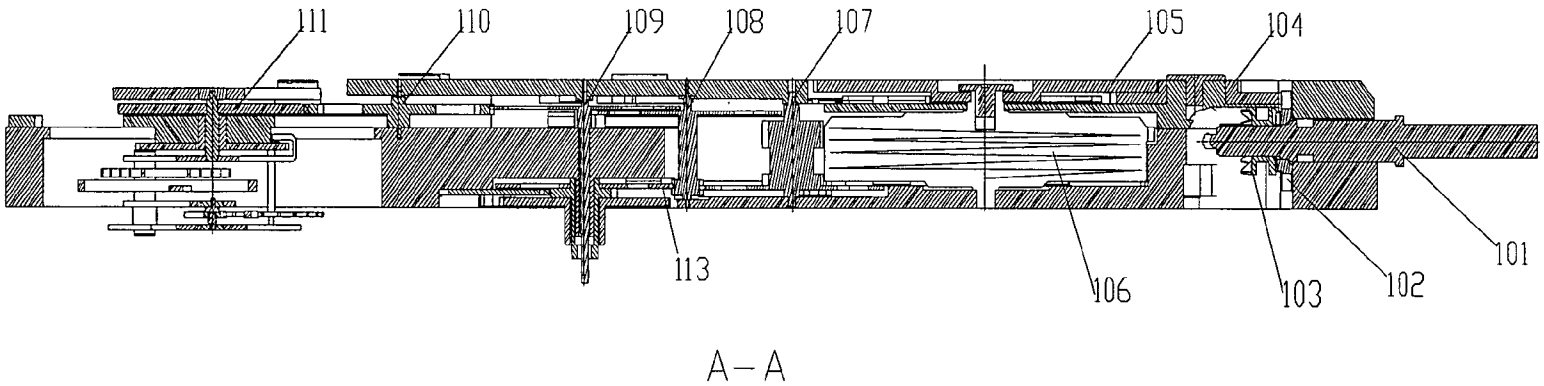
FIG. 2 is a sectional view along the line A-A of FIG. 1.

Specifically, for the horologe disclosed in the above embodiments, the part of its mechanical transmission wheel train is shown in FIGS. 1 and 2. The winding mechanism may include a stem 101, a vertical wheel 102, a clutch wheel 103, a crown wheel 104, a ratchet wheel 105 and a spring barrel 106 where a spring is provided.

The vertical wheel 102 is disposed on the stem 101. The clutch wheel 103 is meshed with the vertical wheel 102 by using one-way (unidirectional) meshing teeth; the crown wheel 104 is meshed with the vertical wheel 102; and the ratchet wheel 105 is meshed with the crown wheel 104. A clamp ring piece 114 makes the ratchet wheel 105 rotate and wind only in one direction.

The winding mechanism is a manual winding mechanism. When the stem 101 is rotated, the vertical wheel 102 on the stem 101 rotates therewith, drives the rotation of the crown wheel 104, and finally drives the rotation of the ratchet wheel 105, thereby winding. That is, the spring provided within the spring barrel 106 is rolled up tightly in the spring barrel 106.

Of course, the winding mechanism may also be an automatic winding mechanism which can wind automatically and has a structure similar to a common automatic winding structure. The automatic winding mechanism will not be described therein.

The mechanical timekeeping gear transmission portion, as shown in FIGS. 1 and 2, includes a central wheel 107, an intermediate wheel 108, a second wheel 109, an intermediate tourbillion 110 and a tourbillion mechanism 111.

Spring barrel teeth external of the spring barrel 106 are meshed with a pinion of the central wheel 107; the pinion of the intermediate wheel 108 are meshed with large teeth of the central wheel 107; the pinion of the second wheel 109 are meshed with large teeth of the intermediate wheel 108; and teeth of the intermediate tourbillion 110 are meshed with large teeth of the second wheel 109. The intermediate tourbillion 110 drives the rotation of a central wheel of the tourbillion mechanism 111, and the timekeeping principle of the tourbillion mechanism 111 is not described therein. A balance wheel, a hairspring, an escape fork and an escape wheel in the tourbillion mechanism 111 control the operational speed of the whole tourbillion mechanism 111. Since the central wheel of the tourbillion mechanism 111 and the intermediate tourbillion 110 are meshed in gear engagement, the rotational speed of the intermediate tourbillion 110 and the second wheel 109 are controlled. The second wheel 109 is meshed with the second transmission wheel 112 by gears. This paragraph relates to the part of the mechanical timekeeping gear transmission.

Also, the pinion of the intermediate wheel 108 is meshed with a cannon wheel piece 113 being in friction connection with a cannon pinion shaft. Teeth of the cannon wheel drive the rotation of a minute shaft, and the minute pinion is meshed with an intermediate hour wheel to drive the rotation of the hour wheel. The second hand, minute hand and hour hand are transmitted at a certain transmission ratio, thus manipulating the operation of the second hand, minute hand and hour hand. The transmission structure from the second wheel 109 to the hour wheel is the same as a common horologe structure, and the time regulating portion is also the same as a common horologe structure, which will not be described herein.

The forgoing is directed to the transmission relation of the mechanical transmission wheel train. The tourbillion mechanism 111 has controlled the timekeeping speed of all of the hands. However, if a high timekeeping accuracy is desired, the machining requirement of the tourbillion mechanism 111 must be high, which increases the manufacturing difficulty. In order to reduce the machining requirement of the tourbillion mechanism 111, there is only a need for the tourbillion mechanism 111 to control the mechanical portion to go faster, such that the rotational speed of the second wheel driven by the mechanical transmission wheel train is faster than the rotational speed of the second wheel in standard time. It is to be noted that, the rotational speed of the second wheel in standard time refers to a rotational speed of the second wheel when it works correctly. Since there are many means to control the mechanical timekeeping portion to go faster, and these means are well known to those skilled in the art, the specific means to make the mechanical timekeeping portion to go faster will not be described in detail.

Figure 3:
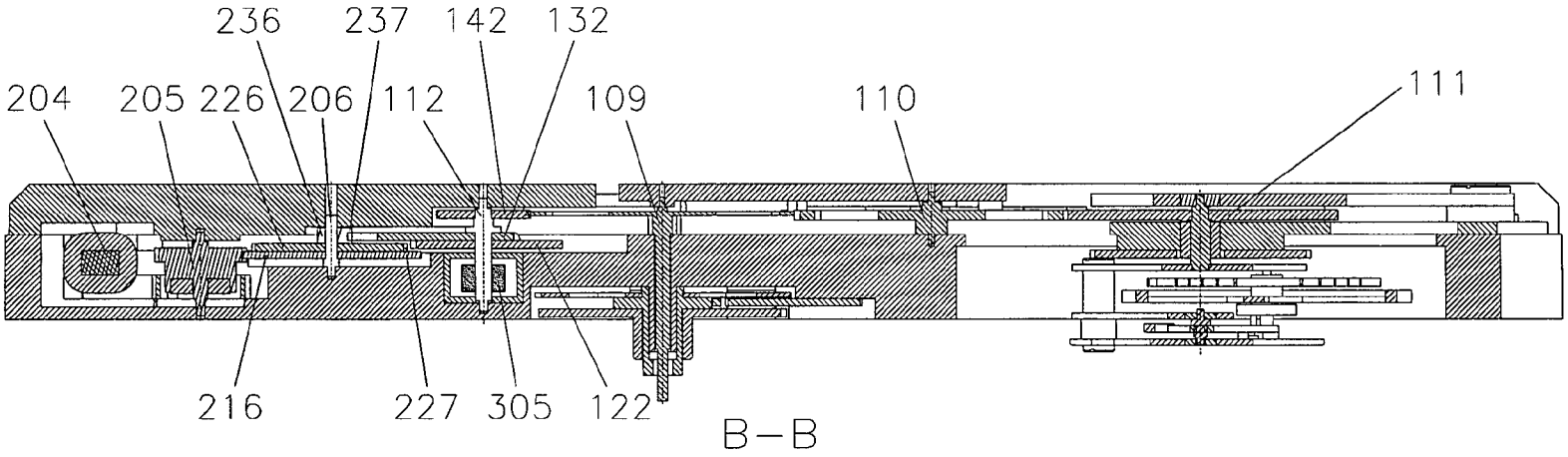
FIG. 3 is a sectional view along the line B-B of FIG. 1.

As shown in FIGS. 1 and 3, the accuracy control device includes: a battery or a capacitor electricity storage device 201, IC (integrated circuit) 202, a quartz 203 and a timekeeping motor 204 of an IC 202 output signal. The accuracy of the IC 202 output signal is controlled by the quartz 203, that is, the timekeeping accuracy of the timekeeping motor 204 is controlled by the quartz 203.

The electronic transmission wheel train includes: a rotor 205; and a first transmission wheel 206 meshed with the rotor 205.

An intermittent motion transmission occurs between the first transmission wheel 206 and the second transmission wheel 112.

In order to save power, the IC 202 may output a timekeeping pulse every 20 seconds. As such, the life of the battery of the horologe disclosed in the present embodiment is several times longer than that of a common quartz horologe.

The timekeeping motor 204 drives the rotor 205 to rotate, and the rotation of the rotor 205 drives the first transmission wheel 206 to rotate. At the same time, the transmission wheel train of the mechanical portion is transmitted to the second transmission wheel 112.

Figure 4:
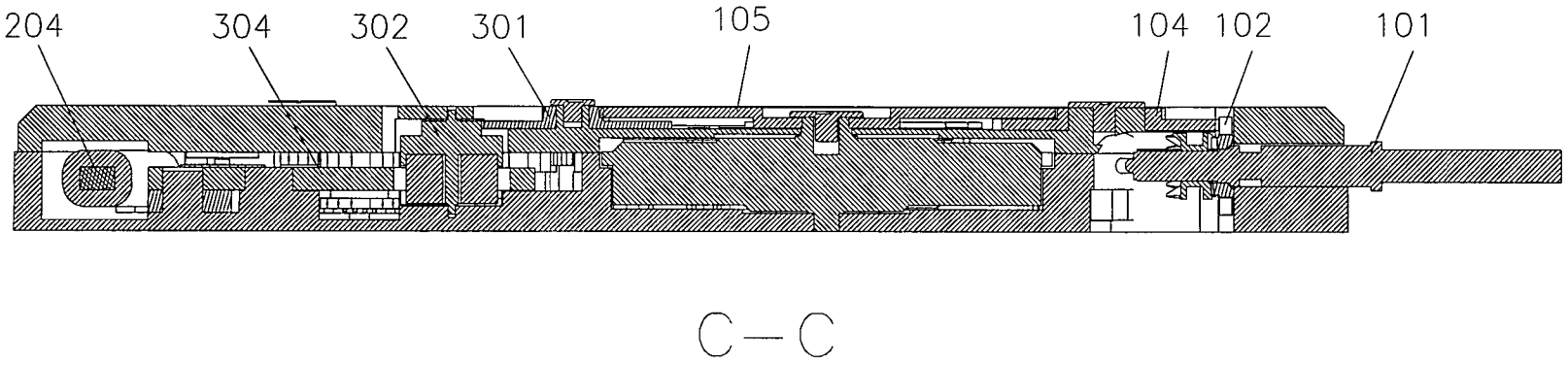
FIG. 4 is a sectional view along the line C-C of FIG. 1.
Figure 5A:
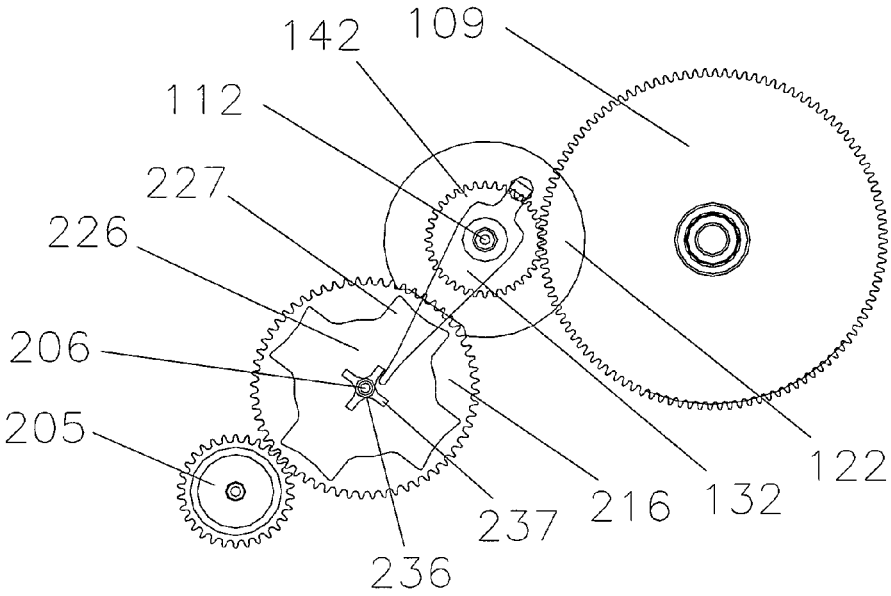
FIG. 5(*a*) and FIG. 5(*b*) are diagrams showing the connection relationship between the first transmission wheel and the second transmission wheel in different states.
Figure 5B:
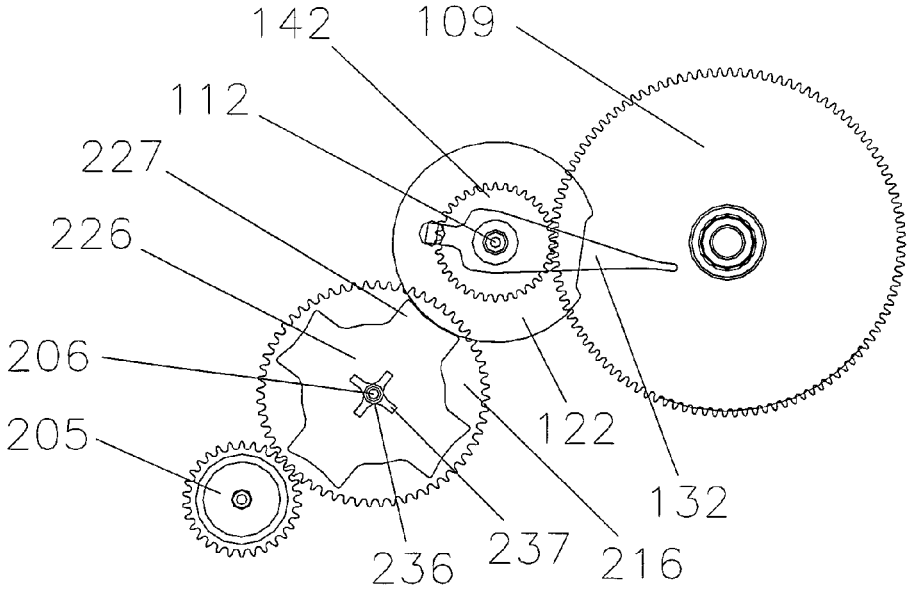

The connection between the first transmission wheel 206 and the second transmission wheel 112 is an intermittent motion mechanism. Specifically, as shown in FIGS. 4 and 5, the transmission ratio of the intermittent motion transmission between the first transmission wheel 206 and the second transmission wheel 112 is 1:4, which may be changed according to an actual need. Each of the first transmission wheel 206 and the second transmission wheel 112 is provided with three wheel pieces. The first wheel piece 216 of the first transmission wheel 206 is a gear wheel meshed with the rotor 205; the first wheel piece 122 of the second transmission wheel 112 is a round wheel piece with a groove; the second wheel piece 226 of the first transmission wheel 206 is provided with a plurality of first wheel blades 227, an outer edge of the first wheel blade 227 being in an inward-concave arc shape engaged with the round wheel piece; the third wheel piece 236 of the first transmission wheel 206 is provided with a plurality of second wheel blades 237; the second wheel piece 132 of the second transmission wheel 112 is a long-arm shaped wheel piece which can extend in between two adjacent second wheel blades 237; and the third wheel piece 142 of the second transmission wheel 112 is a gear wheel meshed with the second wheel 109.

Since the first transmission wheel 206 is controlled by the rotor 205, the locating torque exerted on the rotor 205 by the timekeeping motor 204 prevents the rotation of the first transmission wheel 206. Since the arm of force of the torsion transmitted from the second transmission wheel 112 through the long-arm shaped wheel piece is long, the thrust force exerted on the first transmission wheel 206 by the torsion is reduced. Meanwhile, a portion of the first transmission wheel 206 pushed by the long arm is a portion with a shorter radius of the third wheel piece 236 of the first transmission wheel 206, and thus the second transmission wheel 112 cannot drive the first transmission wheel 206. In this way, the first transmission wheel 206 limits the rotation of the second transmission wheel 112. The length of the arm of force may be changed flexibly, as long as the first transmission wheel 206 can limit the rotation of the second transmission wheel 112. Only when the IC 202 drives the timekeeping motor 204, and thus in turn drives the rotor 205 to rotate, specifically, by 180°, the first transmission wheel 206 just rotates one tooth (just 90° in this example) with a certain transmission ratio. Thus, the second transmission wheel 112 may go on rotating, that is, the mechanical hands may work continuously. Then, the second transmission wheel 112 is limited by the first transmission wheel 206 again, and when the IC 202 again drives the rotor 205 to rotate, the mechanical hands again may work continuously. That is, the rotational speed of the second transmission wheel 112 may be controlled by the IC 202, thereby controlling the rotational speed of the second wheel 109, i.e., controlling the timekeeping accuracy of the second hand.

When the energy of the spring of the mechanical portion has been run out, the transmission of the mechanical portion will stop rotating, and particularly, both the second wheel 109 and the second transmission wheel 112 stop rotating, when the IC 202 drives the rotor 205 to rotate, the rotation of the rotor 205 drives the first transmission wheel 206 to rotate. However, there is an engagement of intermittent motion mechanism between the first transmission wheel 206 and the second transmission wheel 112. As shown in FIG. 5, the outer edge of the first wheel piece 216 of the first transmission wheel 206 is in the inward-concave arc shape engaged with the round wheel piece, and the second transmission wheel 112 only acts as a driving wheel. If the second transmission wheel 112 does not rotate, the first transmission wheel 206 cannot rotate. Since the first transmission wheel 206 cannot rotate, the rotor 205 also cannot rotate.

In order to reduce the energy consumption, the IC 202 also has an automatically identified stopping/starting timekeeping function. When the energy of the spring of the mechanical portion has been run out, the transmission of the mechanical portion will stop rotating, and the IC 202 may continue outputting a pulse to drive the rotor 205. If the rotor 205 yet has not been driven after 10 times, the IC 202 enters a "sleep" state, and no longer outputs a signal to the timekeeping motor 204, thereby saving electricity. The number of times of outputting a signal may be set arbitrarily in the IC 202, being 10 in this example.

When winding-up, the rotation of the ratchet wheel 105 drives the electricity generating intermediate wheel 301, and then drives the rotation of the electricity generating wheel 302. When the electricity generating wheel 302 generates the electricity, the IC 202 is triggered to start working, and control the timekeeping rotor 205 again. Meanwhile, after generating the electricity, the electricity is stored in the capacitor electricity storage device 201 through the IC 202 and other electronic elements. The activation of the IC 202 further includes triggering the starting function by a switch. Specifically, as shown in FIG. 1 and FIG. 4, when winding-up, the rotation of the ratchet wheel 105 drives the electricity generating intermediate wheel 301, and then drives the rotation of the electricity generating wheel 302. The electricity generating wheel 302 moves the triggering switch 303. A moving sheet is in communication with the positive pole of the IC 202, and the other sheet of the triggering switch 303 (only in FIG. 1 be shown) is in communication with a triggering end of the IC 202. When the triggering switch 303 is continuously triggered for 5 times within 3 seconds, the IC 202 is reactivated. The number of times of triggering the triggering switch 303 activated by the IC 202 may be set by the IC 202. It is to be noted that, the capacitor electricity storage device described above also may be IC electricity storage device. Generally, electricity energy stored for more than 20 seconds in the IC/capacitor electricity storage device may be sufficiently used for an IC, a crystal oscillator and a motor rotor wheel. This method of storing the electricity can increase several times the life of the conventional battery, and can save the space.

In the timekeeping system of the horologe disclosed in the embodiments of the present application, the accuracy control device may be powered by an electricity generating device in addition to a battery, and the electricity generating device generates the electricity by manually winding-up. The electricity generating device includes: a winding mechanism, an electricity generating motor, a voltage transformation and stabilization device connected with the generating motor, and an electricity storage device connected with the voltage transformation and stabilization device. A coil of the electricity generating motor and a coil for controlling the timekeeping time are in common as the timekeeping motor 204. Of course, a separate electricity generating coil can be used, having an electricity generating stator 304. When winding-up, the rotation of the ratchet wheel 105 drives the electricity generating intermediate wheel 301, and then drives the rotation of the electricity generating wheel 302. After the electricity generating wheel 302 generates the electricity, the electricity is stored in the electricity storage device 201 after passing through the voltage transformation and stabilization device.

The energy of the spring may also be used to generate electricity. As shown in FIG. 3, motion is transmitted from a tooth of the spring barrel to the second wheel 109 through gear acceleration and then is acceleratingly transmitted to the second transmission wheel 112. A shaft of the second transmission wheel 112 is coaxial with that of a micro-generator 305, and the rotation of the second transmission wheel 112 drives the rotation of the shaft of the micro-generator 305, thereby generating the electricity. After the electricity is generated, the electricity is stored in the electricity storage device 201 after passing through the voltage transformation and stabilization device.

FIG. 5 is a detailed view of the intermittent cooperation between the first transmission wheel 206 and the second transmission wheel 112, and FIG. 5(*a*) is an instantaneous view when the wheel train of the mechanical portion drives the long arm of the second transmission wheel 112 to press against a barrier sheet of the third wheel piece 236 of the first transmission wheel 206. After the long arm of the second transmission wheel 112 presses against the first transmission wheel 206, it waits until the electronic portion drives the rotation of the rotor 205. Only after the rotor 205 rotates, the second transmission wheel 112 can go on rotating. FIG. 5(*b*) is an instantaneous view when the wheel train of the mechanical portion drives the normal motion of the second transmission wheel 112. At this stage, the second transmission wheel 112 is not hindered, and the mechanical transmission portion operates normally. However, since the first wheel piece 122 of the second transmission wheel 112 has a cylindrical surface engaged with a small clearance with an inner arc concave surface of a special-shaped tooth of the second wheel piece 226 of the first transmission wheel 206, the second transmission wheel 112 may limit the rotation of the first transmission wheel 206 at this time. Only when a groove on the cylindrical surface of the first wheel piece 122 of the second transmission wheel 112 is aligned with the first transmission wheel 206, the first transmission wheel 206 can rotate.

Figure 6A:
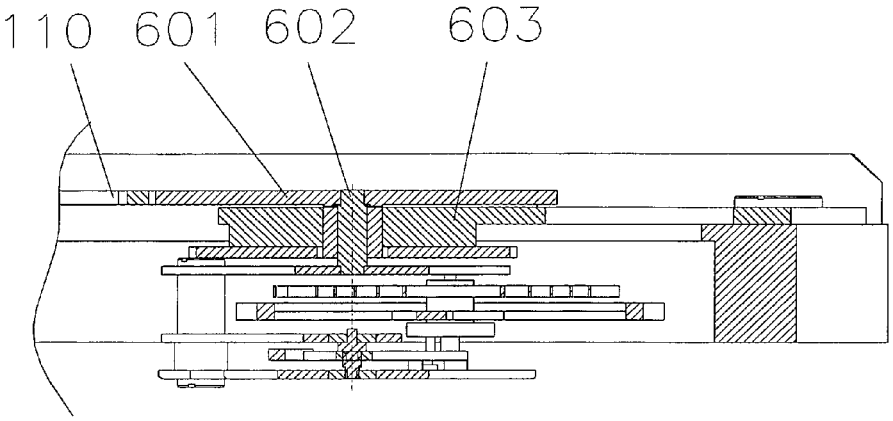
FIG. 6(*a*) is a structural schematic view of a tourbillion disclosed in an embodiment of the present application.
Figure 6B:
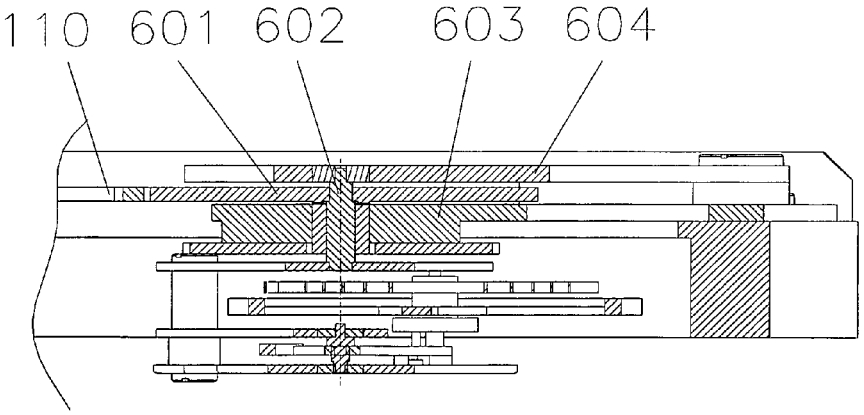

FIG. 6 is a detailed comparison diagram between the new tourbillion and the old tourbillion. In the parts of the tourbillion mechanism 111, the present application incorporates one fixing splint 604 into the common tourbillion structure. The tourbillion mechanism 111 in FIG. 6(*a*) has only one first fixing splint 603, and a central wheel of the tourbillion is shown at 601, and only one end of a central shaft 602 thereof is positioned. A central shaft 602 of the tourbillion mechanism in FIG. 6(*b*) can extend and is positioned by a second fixing splint 604, and the second fixing splint 604 is also fixed on the first fixing splint 603, such that both ends of the central shaft 602 of the tourbillion become positioned, thus improving the stability of the tourbillion mechanism 111.

Figure 7A:
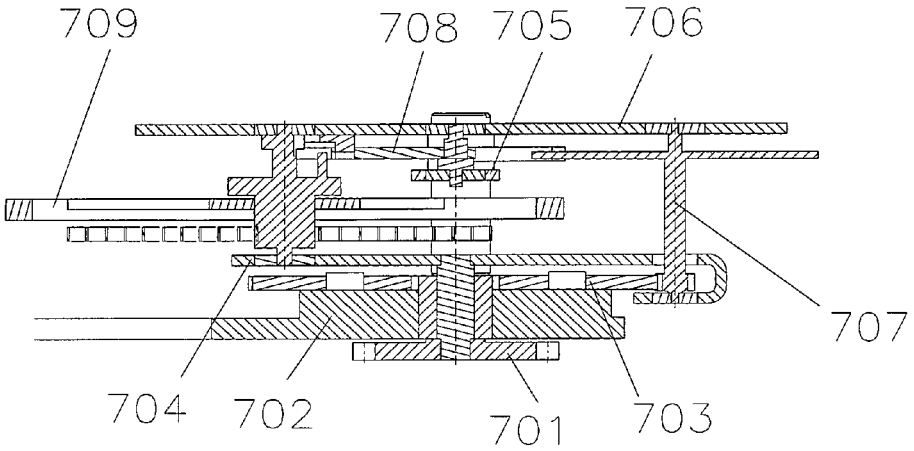
FIG. 7(*a*) is a schematic view of a tourbillion mechanism disclosed in an embodiment of the present application.
Figure 7B:
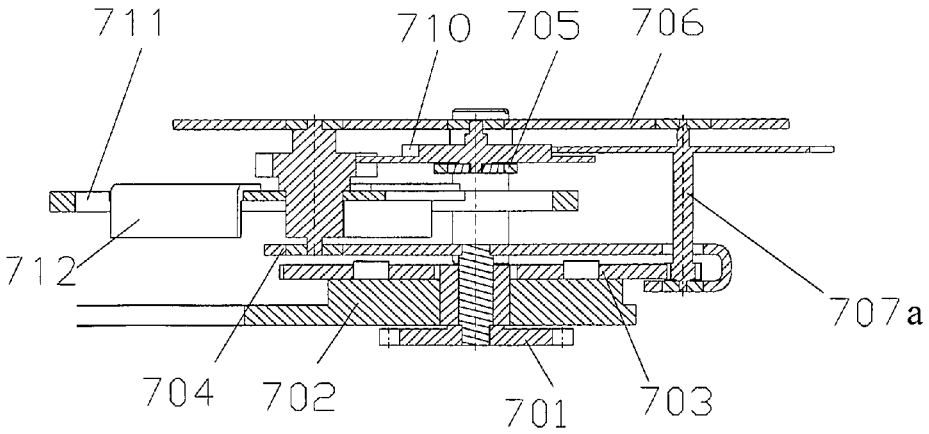

FIG. 7 shows tourbillion mechanisms 111 in two different forms. Specifically, FIG. 7(*a*) shows a tourbillion mechanism 111, including a tourbillion central wheel 701, a tourbillion mechanism fixing splint 702, a fixing central wheel 703, a first tourbillion splint 704, a second tourbillion splint 705, a third tourbillion splint 706, an escape wheel 707, an escape fork assembly 708, and a balance wheel assembly 709. The swinging of the balance wheel controls the rotational speed of the escape wheel 707, thereby controlling the rotational speed of the whole mechanical wheel train. Such a tourbillion mechanism 111 is a relatively common tourbillion mechanism in the prior art, and thus is not described herein. In the present application, this common tourbillion mechanism can be used to control the rotational speed of the gear wheel of the mechanical portion, as long as the second wheel controlled by the common tourbillion mechanism goes faster than the standard time, without the need for accurately controlling the timekeeping accuracy. The final accuracy is guaranteed by the electronic wheel train of the accuracy control mechanism.

Since the timekeeping accuracy can be controlled by the electronic wheel train, a new type of tourbillion mechanism 111 may be used, as shown in FIG. 7(*b*). An escape wheel of the common tourbillion may be changed into a flywheel 707*a* (the escape wheel piece is changed into a gear wheel piece); an accelerating wheel 710 and a large flywheel 711 are used to replace the escape fork and the balance-spring assembly; and a resistance sheet 712 is mounted on the large flywheel 711. 4 resistance sheets 712 are mounted in the present example, and the number of the resistance sheet 712 may be determined according to an actual need, as long as the rotational speed of the large flywheel 711 can be controlled by regulating the angle or number of the resistance sheet 712. The air resistance from the resistance sheet 712 mainly limits the rotational speed of the large flywheel 711. The gear wheel transmission ratio may be determined such that the rotational speed of the second wheel 109 is slightly faster than the rotational speed of the second wheel in the standard time. The final accuracy of the second wheel 109 is guaranteed by the electronic wheel train of the accuracy control mechanism. This new type of tourbillion mechanism will have two flywheels, that is, the balance wheel in the common tourbillion mechanism also becomes a flywheel; and it also has a sweep second hand, which goes in super silent. Since there is no need for the balance-spring assembly 709 and the escape fork assembly 708, the machining and manufacturing difficulty is reduced greatly and the cost is saved.

The embodiments herein are described in a progressive manner. The differences between the embodiments are illustrated emphatically, and the same or similar parts among the embodiments refer to one another.

The above description of the disclosed embodiments enables the person skilled in the art to practice and use the application. Various modifications to these embodiments may be obvious to the person skilled in the art. The general principle defined therein may be implemented in other embodiments without departing from the spirit and scope of the application. Thus, the application is not limited to these embodiments illustrated herein, but conforms to a broadest scope consistent with the principle and novel features disclosed herein.

What is claimed is:

1. A horologe equipped with a timekeeping system, said timekeeping system comprising:

a winding mechanism providing power for a second hand, a minute hand and an hour hand;

a mechanical transmission wheel train engaged with said winding mechanism and driving said second hand, said minute hand and said hour hand to operate, said mechanical transmission wheel train comprising a tourbillion mechanism, said tourbillion mechanism driving a second wheel that is connected with said second hand to make said second hand rotate, wherein said mechanical transmission wheel train further comprising a second transmission wheel, said second transmission wheel being located at the output end of the mechanical transmission wheel train and meshing with said second wheel, the rotational speed of said second wheel driven by said mechanical transmission wheel train being faster than that of the second wheel in standard time;

an accuracy control device comprising a timekeeping motor for driving a rotor to make it rotate, the timekeeping accuracy of said timekeeping motor being controlled by a quartz crystal oscillator; and an electronic transmission wheel train connected with said rotor and comprising a first transmission wheel, both said first transmission wheel and said second transmission wheel being provided with three wheel pieces, a first wheel piece of said first transmission wheel being a gear wheel meshed with said rotor, a first wheel piece of said second transmission wheel being a round wheel piece with a groove, a second wheel piece of said first transmission wheel being provided with a plurality of first wheel blades, an outer edge of said first wheel blade being in an inward-concave arc shape meshed with said round wheel piece, a third wheel piece of said first transmission wheel being provided with a plurality of second wheel blades, a second wheel piece of said second transmission wheel being a long-arm shaped wheel piece which can extend in between two adjacent second wheel blades, and a third wheel piece of said second transmission wheel being a gear wheel meshed with said second wheel.

2. The horologe according to claim 1, wherein the transmission ratio of said second transmission wheel to said first transmission wheel is 1:4.

3. The horologe according to claim 1, wherein both ends of the central shaft of said tourbillion mechanism are provided with a fixing splint.

4. The horologe according to claim 1, wherein said tourbillion mechanism comprises: a large flywheel with a gear wheel piece and without hairspring and escape fork, an intermediate wheel meshed with said gear wheel piece of said large flywheel, and a flywheel meshed with said intermediate wheel, both said large flywheel and said flywheel making revolutions around the central shaft of said tourbillion mechanism and rotating around their own axes, said large flywheel being provided with a resistance sheet to limit its speed.

5. The horologe according to claim 4, wherein said accuracy control device is powered by a battery or an electricity generating device.

6. The horologe according to claim 5, wherein said winding mechanism comprises:

a stem;

a vertical wheel installed at said stem;

a clutch wheel meshed with said vertical wheel via one-way meshing teeth;

a crown wheel meshed with said vertical wheel;

a ratchet wheel meshed with said crown wheel, a tooth of said ratchet wheel being clamped by a clamp ring piece, and an one-way deformable sliding tooth being provided on said clamp ring piece; and a spring barrel with a spring, the periphery of said spring barrel being provided with a spring barrel tooth, said spring barrel tooth being connected with one end of said spring.

7. The horologe according to claim 6, wherein said electricity generating device comprises an electricity generating motor, a voltage transformation and stabilization device connected to said generating motor, an electricity storage device connected to said voltage transformation and stabilization device, an electricity generating intermediate wheel driven by said ratchet wheel, and an electricity generating wheel driven by said electricity generating intermediate wheel, said electricity generating motor being driven by said electricity generating wheel.

8. The horologe according to claim 6, wherein said electricity generating device comprises a micro-generator, a voltage transformation and stabilization device connected to said micro-generator, and a capacitor electricity storage device or an integrated circuit electricity storage device connected to said voltage transformation and stabilization device, said micro-generator being coaxially connected to said second transmission wheel.

9. The horologe according to claim 7, wherein said accuracy control device is provided with an integrated circuit ("IC") with a module capable of automatically recognizing the timekeeping state of stop and start, said module entering sleep mode if it has outputted a preset number of times of pulses after said mechanical transmission wheel train stops and said rotor stops, said module starting to work and to control said rotor again if it is triggered by the electricity generated from driving said electricity generating motor by the rotation of said ratchet wheel when said winding mechanism is wound up, said module further comprising a trigger switch capable of being toggled by the gear wheel of said ratchet wheel when said ratchet wheel rotates, said module becoming activated when said trigger switch is continuously triggered for several times within several seconds, said electricity generating motor and said timekeeping motor sharing a common coil or having separate coils.

10. The horologe according to claim 9, wherein said IC outputs a signal to said timekeeping motor every 20 seconds, said timekeeping motor driving said rotor to rotate once for each said signal.

* * * * *